US006060018A

United States Patent [19]

Yoshida et al.

[11] Patent Number: 6,060,018

[45] Date of Patent: May 9, 2000

[54] COLD TOOL STEEL FEATURING HIGH SIZE STABILITY, WEAR-RESISTANCE AND MACHINABILITY

[75] Inventors: Junji Yoshida; Yuji Machida; Keiichi Hayashida; Masaaki Otakane, all of Shinminato, Japan

[73] Assignee: Nippon Koshuha Steel Co., Ltd., Shinninato, Japan

[21] Appl. No.: 09/151,469

[22] Filed: Sep. 11, 1998

[30] Foreign Application Priority Data

Sep. 12, 1997 [JP] Japan ..... 9-268010
Mar. 26, 1998 [JP] Japan ..... 10-098493

[51] Int. Cl.[7] ..... C22C 38/60; C22C 38/24

[52] U.S. Cl. ..... 420/42; 420/69; 420/101; 148/325; 148/326

[58] Field of Search ..... 420/42, 69, 101; 148/325, 326

[56] References Cited

FOREIGN PATENT DOCUMENTS

| | | | |
|---|---|---|---|
| 48-4695 | 2/1973 | Japan | 420/69 |
| 52-37511 | 3/1977 | Japan | 420/101 |
| 61-19762 | 1/1986 | Japan | 420/42 |

*Primary Examiner*—Deborah Yee
*Attorney, Agent, or Firm*—Lackenbach Siegel

[57] ABSTRACT

Cold tool steel having superior machinability, wear-resistance and minimized heat treatment size-change were obtained by specifying components and contents thereof, especially of C, Cr, Si, V and Mo, not by high-temperature soaking. Further, such prehardened cold tool steals as having excellent machinability even after heat-treatment together with minimum size-change were manufactured by further strictly specifying components, particularly of C, Si, Mn, Mo, V, and by specifying heat-treatment conditions.

4 Claims, 17 Drawing Sheets

X : HARDNESS

Y : WEAR-RESISTING MACHINABILITY INDEX

MACHINABILITY INDEX :
HARDNESS OF A COLD TOOL STEEL OF THE PRESENT INVENTION/
MACHINABILITY OF SKD11

WEAR-RESISTING MACHINABILITY INDEX :
MACHINABILITY INDEX ×
WEAR-RESISTANCE OF A COLD TOOL STEEL OF THE PRESENT INVENTION

Fig. 34

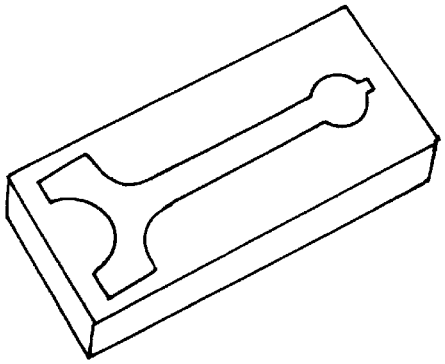

| WORK NAME | | CONNECTING ROD | |
|---|---|---|---|
| MATERIAL | | XD-11S | |
| PROCESS | | ROUGH | FINISH |
| CUTTER | | R1.0 I 0.004$^{N}$ I (CARBIDE) TiN COATING | |
| Z STEP | mm I inch I | 0.25 I 0.01$^{N}$ I | 0.1 I 0.004$^{N}$ I |
| STEP | mm I inch I | 0.25 I 0.01$^{N}$ I | 0.1 I 0.04$^{N}$ I |
| SPDL SPEED | min | 25,000 | 25,000 |
| FEEDRATE | mm/min I ipm I | 2,500 I 98 I | 2,500 I 98 I |
| CNC SHAPE | | OFF | ON |
| LENGTH | m I ft I | 140 I 466 I | 80 I 267 I |
| MACH TIME | min | 50 | 22 |
| VOLUME | cc I in 'I | 16 I 1.0 I | |
| COOLANT | | MIST COOLANT | |
| REMARKS | | | |

THE NUMBER OF TOOLS FOR MANUFACTURING A DIE

| HARDNESS | SKD11 | A COLD TOOL STEEL OF THE PRESENT INVENTION |
|---|---|---|
| 60HRC | 10 | 3 |
| 58HRC | 8 | 1 |
| 55HRC | 8 | 1 |
| 53HRC | 8 | 1 |

COLD TOOL STEEL FEATURING HIGH SIZE STABILITY, WEAR-RESISTANCE AND MACHINABILITY

FIELD OF THE INVENTION

The present invention relates to cold tool steels, having minimum size-change contingent to heat-treatment, high wear-resistance and high machinability, applicable for die, gauge, shearing blade, press-mold, punch, brick mold, mold for power molding, die cutter, roller and the like, to be covered by SKD 11, SKD 12 and SKD 1, as specified by JIS G4404.

BACKGROUND OF THE INVENTION

Heretofore, wear-resistance, machinability and toughness of cold tool steels have been improved, indeed. However, in order to cope with the recent cold dies, requiring cast saving, fast delivery and precise size, the most important problem, that is to minimize the size-change contingent to the heat-treatments, especially to hardening or tempering, has not bee solved, as yet.

Among various heat-treatment deformations, the size-change caused by wrong cutting direction, warping and/or twisting can be solved by reasonable measurements. However, said size-change contingent to hardening or tempering cannot be avoided, because said change will be caused by thermal stress and transformation-stress, and the extent of such change depends upon cooling velocity, elasticity limit, heat conductivity, residue of austenite, carbides, and configuration of the dies material, itself.

Jpn. Pat. Publn. No. H.4-116122 describes that the machinability has been improved remarkably by dispersion of carbides and metallographic uniformity attained by controlling the treat-temperature between 1150–900° C., and the draft-ratio at 3 or over, as well as by controlling the quantity of carbon and of carbonizing elements. These results were achieved from the point of view that the uniformity of metallographic organization around the primary carbide is important for machinability, toughness and brittle-proofing, it arranges.

Also Jpn. Pat. Publn. No. H.8-120333 discloses the manufacturing method of cold tool steel being provided with effective wear-resistance, machinability and toughness.

Further, Jpn. Pat. Publn. S.56-16975 reveals to provide steels with good quenching property and thermal deflection, both through finding the important rolls of the quantity of aluminum and nitrogen in the steel in the manufacturing of desired steel, both elements of which have not so far been considered to have such roles.

None of the prior arts, however, have achieved to minimize the size-change contingent to hardening and/or tempering.

On the other hand, some steels, as Jpn. Pat. Publn. Nos. S.63-183185 & S.52-1372 indicates, were cut directly after pre-hardening and used as dies mainly for plastics.

Because of being free of deformation of scale, said pre-hardened steels were advantageous as regards delivery and cost.

However, said steels had relatively low hardness, ranging 10~45 HRC, and therefore were not used for highly wear-resistant press-molds or punches to which JIS SKD 11 is applied. The reason for it is that the machinability of said steels was very low in the state of higher hardness beyond 55 HRC, and in turn, their wear-resistance was so poor, in the lower hardness state, that they could not be used practically.

In order to resolve various problems as mentioned above, the present inventors propose, as described in Jpn. Pat. Publn. No. H.8-120333 and Jpn. Pat. Publn. No. H.9-268010, such cold tools steels as having the improved machinability contingent to heat-treatment, wherein, the optimum components and the percentage thereof for minimizing the size-change contingent to hardening and tempering were determined through repeated investigations and analyses.

Another object of the present invention is to provide, combining said inventions as mentioned above, such cold tool steels as having excellent toughness wear-resistance, and high-machinability even at the hardness as high as 55~60 HRC, all of which are superior than those as specified for JIS SKD 111.

SUMMARY OF THE INVENTION

In order to resolve said problems, cold tools steels as set forth in claim 1 comprises the components and weight percentages thereof, as follows;

C: 1.10~1.35

Cr: 900~12.00

Si: 0.10~0.30

V: 0.20~0.45,

Mo: 1.00~1.35, wherein, Cr/C: 6.0~10.00, with the rest being Fe and inevitable impurities.

Said steels are characterized in the minimized size-change contingent to heat-treatments, and in the high wear-resistance and machinability.

Further, the cold tool steels pursuant to the present invention are characterized in comprising the components and weight percentages thereof, as follows;

S: 0.40~0.17

Moreover, inventors have achieved the present invention, being based on the findings, as follows:

In order to improve the machinability after heat treatments, the components and the weight percentages thereof must be:

C: 1.10~1.35,

Si<0.30

Cr: 9.00~11.00,

Mo: <1.35

V: 0.45 with weight ratio of Cr/C being 6.00~10.00, requiring addition of S:0.04~0.17 for higher machinability.

In order to improve machinability even at the higher hardness after tempering, said steels must comprise more limited components and weight percentages, as follows:

C: 1.10~1.35,

Si: 0.175~0.300,

Cr: 9.00~11.00,

Mo>1.10,

V: 0.25~1.20,

S: 04~0.17

For improving wear-resistance, said steels shall consist essentially of components and weight percentages thereof, as follows:

C: 1.20~1.35,

Si: 0.20~0.35,

Cr: 9.00~11.50,

Mo>1.10,

V: 0.20,

S: 0.04~0.17

Where remarkable machinability and wear-resistance are required at high hardness heat-treatment conditions must be specified. Namely, tempering must be several times at 500~570° C. or higher and resultant hardness 54.8~60 HRC is essential. For further improvement, hardness must be controlled at 55.9~59 HRC, with target being 57.5 HRC.

Namely, the present invention set forth in claim 2 provides cold tool steel characterized in high machinability, having 55~60 HRC and consisting essentially of the components and wt. percentages thereof, as follows:

C: 1.20~1.35,

Si: 0.20~0.30,

Mn: 0.30~0.42,

Cr: 9.00~11.00,

Mo: 1.10~1.35,

V: 0.20~0.45

S: 0.04~0.17 and the rest containing Fe and inevitable impurities. The hardness is specified at 55~60 HRC even after hardening and tempering. Claim 9 provides cold tool steel, as set forth in claim 2 , satisfying the wear-resisting machinability index, as follows:

$$1800<25329-0.325\times(HRC)^3+27.05\times(HRC)^2+15.9\times(\%\text{ of residual austenite})^2-329.9\times(\%\text{ of residual austenite})$$

Further, claim 12 provides cold tool steel, as set forth in claims 2 or 3, characterized in 55~60 HRC after heat-treating several times, each comprising hardeing and tepering at 505° C.~570° C. Moreover, claim 15 provides cold tool steel features to have 56~59 HRC after tempering at 510° C.~570° C.

BRIEF DESCRIPTION OF THE DRAWINGS

FIG. 34 is a perspective view of a die to manufacture connection rod. Rod manufacturing specifications and number of tools used for the manufacturing are shown, also.

DETAILED DESCRIPTION OF THE INVENTION AND DESCRIPTION OF THE PREFERRED EMBODIMENTS

Figure 1:
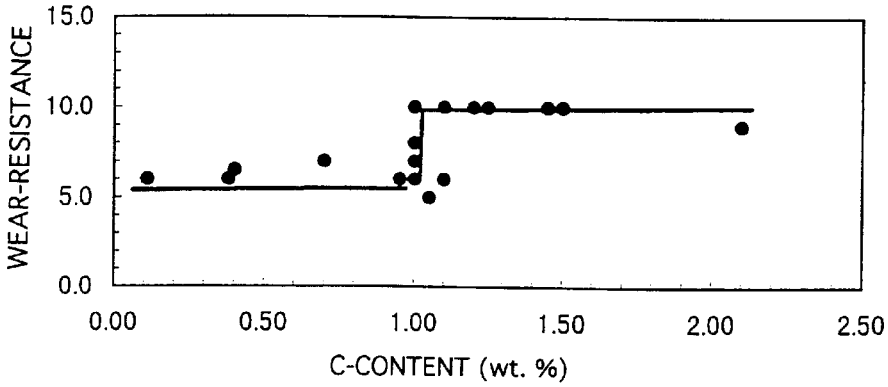
FIG. 1 is a graph indicating the relation of C-content (wt. %) to wear-resistance.
Figure 2:
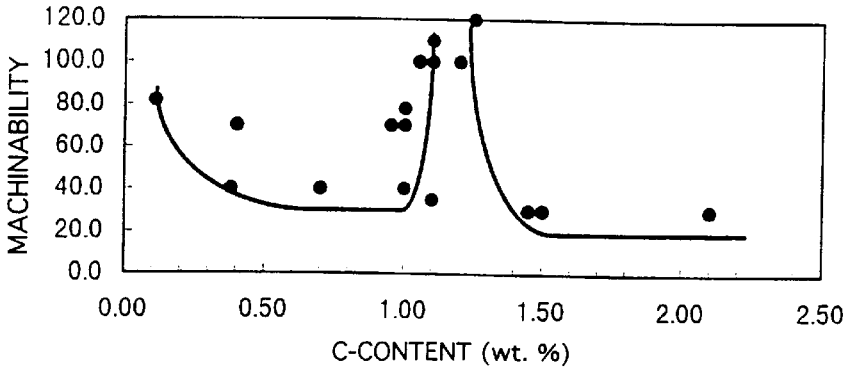
FIG. 2 is a graph indicating the relation of C-content (wt. %) to machineability.

As regards such cold tool steel tried by us, wherein wt. % of C is 1.0, wear-resistance falls remarkably, as indicated by FIG. 1, and where C-content is less than 1.10 or over 1.35 wt. %, machinability is reduced, as shown in FIG. 2. Then, in order to secure wear-resistance and machinability both, C-content must be 1.10~1.35 wt. %.

Figure 3:
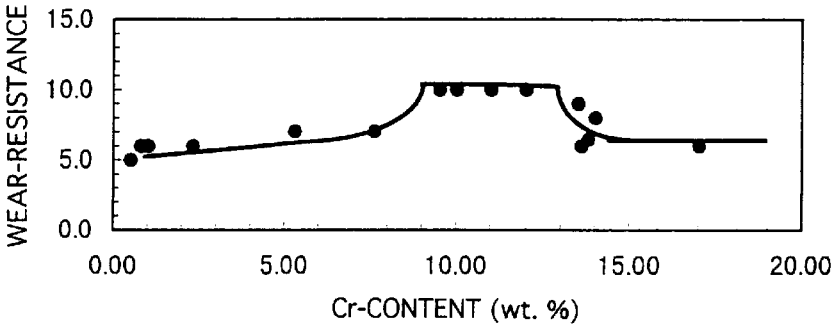
FIG. 3 is a graph indicating the relation of Cr-content (wt. %) to wear-resistance.
Figure 4:
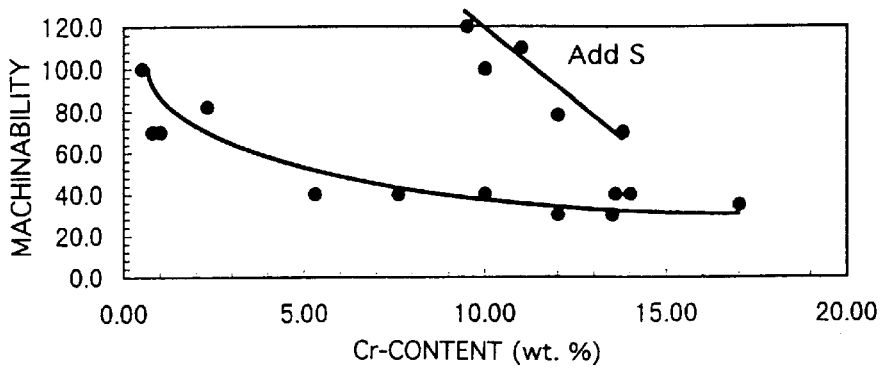
FIG. 4 is a graph indicating the relation of Cr-content (wt. %) to machinability.

In case Cr-content is less 9.00 and over 12.00, as shown in FIG. 3, wear-resistance falls down. And, the greater is Cr-content, the lower is machinability, as indicated in FIG.

3. Therefore, Cr-content is preferable to fall within 9.00~12.00 wt. %.

Figure 5:
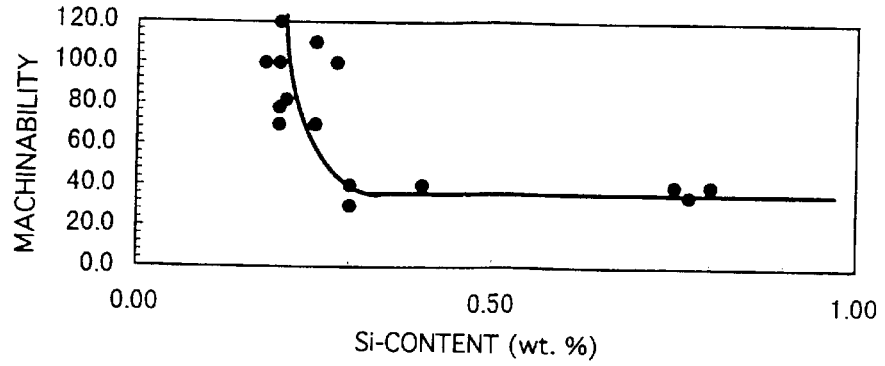
FIG. 5 is a graph indicating the relation of Si-content (wt. %) to machinability.
Figure 6:
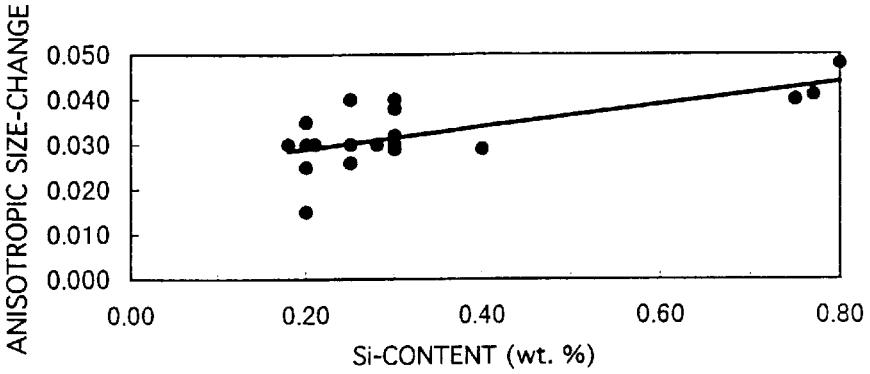
FIG. 6 is a graph indicating the relation between Si-content and anisotropic size-change after heat-treatment.

As shown in FIGS. 5 & 6, the less is the Si-content, the better are machinability and anisotropic size-change after heat-treatment. Namely, for higher machinability, wt. % of Si shall be ≦0.30. Further, Si is added as deoxidant and machinability improver, therefore, in case Si-content is less than 0.10 wt. %, only the least effect is expected. So, Si-content is preferred to be 0.10~0.30 wt. %.

Figure 7:
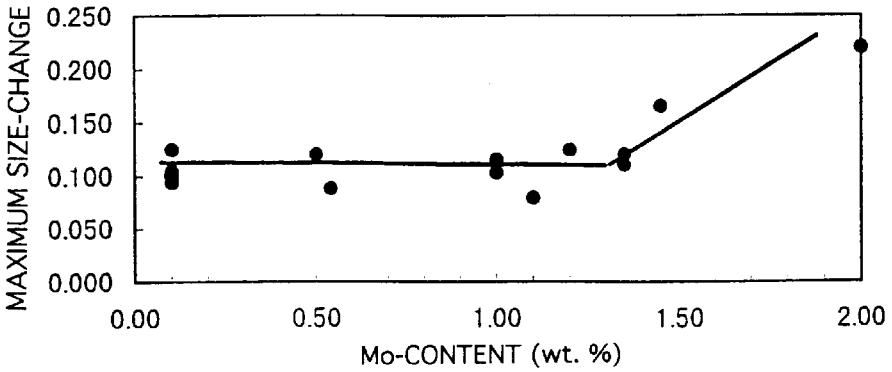
FIG. 7 is a graph indicating the relation of Mo-content to maximum size-change after heat-treatment.
Figure 8:
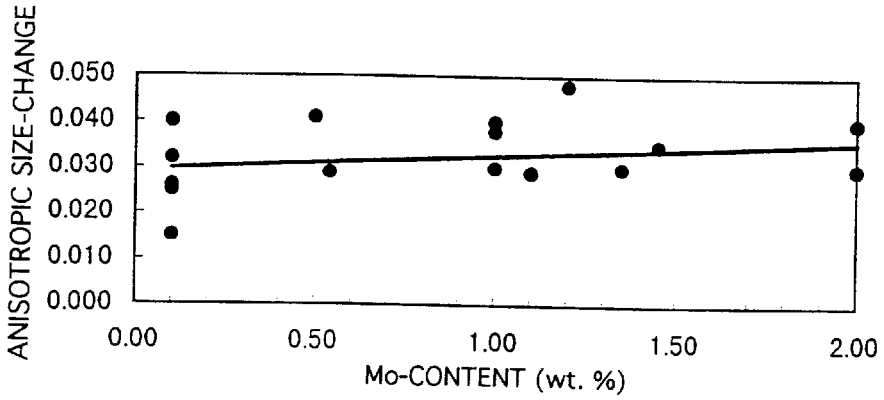
FIG. 8 is a graph indicating the relation of Mo-content to anisotropic size-change contingent to heat-treatment.

As shown in FIG. 7, the Mo-content of over 1.35 wt. % will increase the maximum size-change during the heat-treatment. In order to solid-dissolve in the substrate, resulting in high hardening property and high resistance against tempering, as well as in improving wear-resistance, Mo-content needs to be over 1.00 wt. %.

Figure 9:
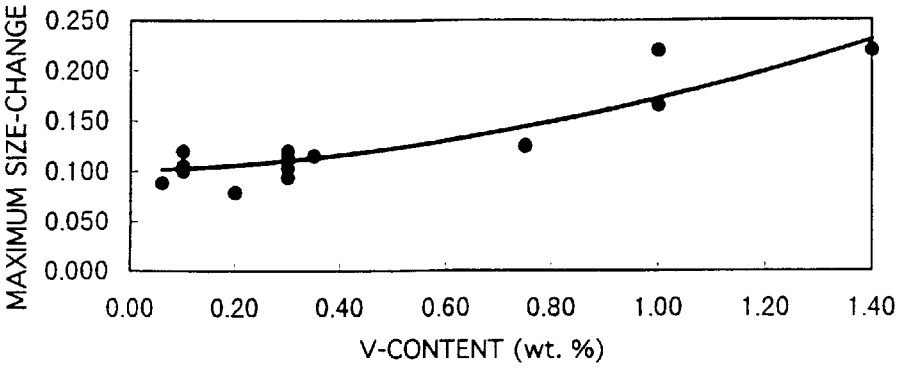
FIG. 9 is a graph indicating the relation of V-content to the maximum size-change contingent after heat-treatment.

As shown in FIG. 9, V-content of over 0.45 wt. % will make the maximum size-change during heat-treatment. And, the minimum V-content enough to make crystal powder finer and to improve wear-resistance is over 0.20 wt. %. So, V-content is preferable to be 0.20~0.45 wt. %.

Figure 10:
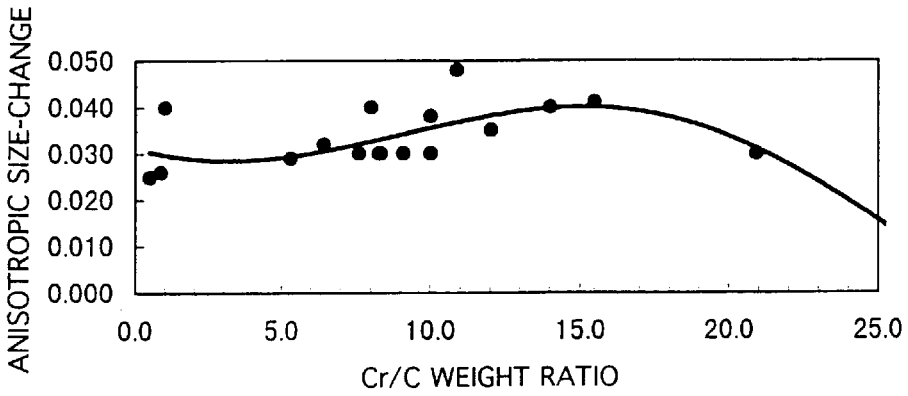
FIG. 10 is a graph indicating the relation between weight ratio of Cr/C and anisotropic size-change contingent after heat-treatment.
Figure 11:
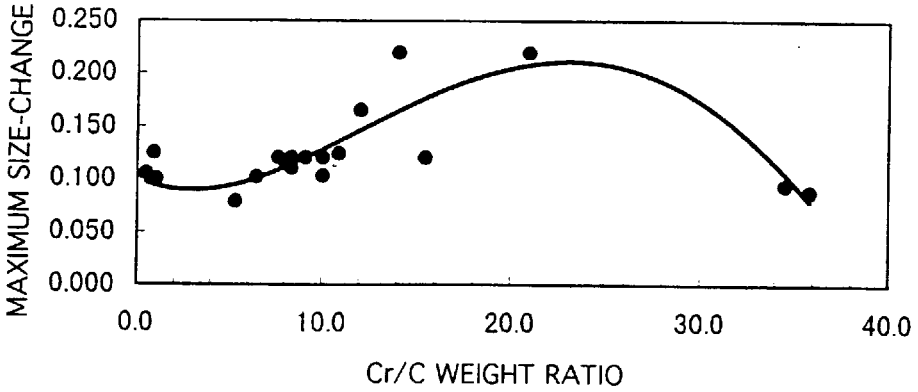
FIG. 11 is a graph indicating the relation of Cr/C weight ratio to maximum size-change after heat-treatment.
Figure 12:
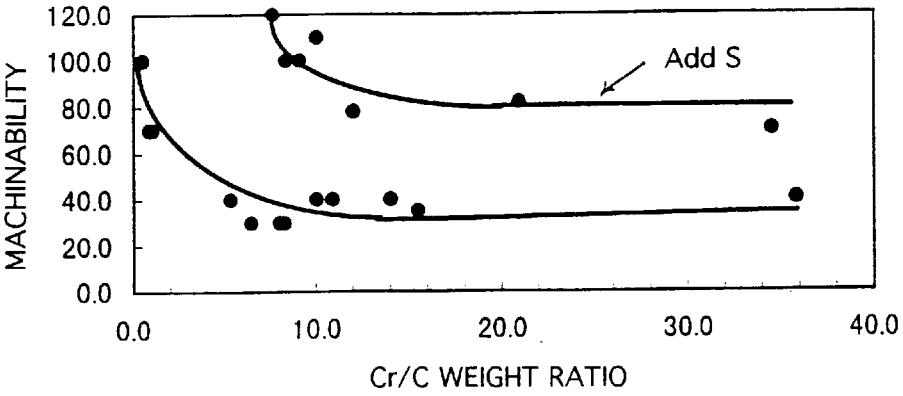
FIG. 12 is a graph indicating the relation of Cr/C weight ratio to machinability.
Figure 13:
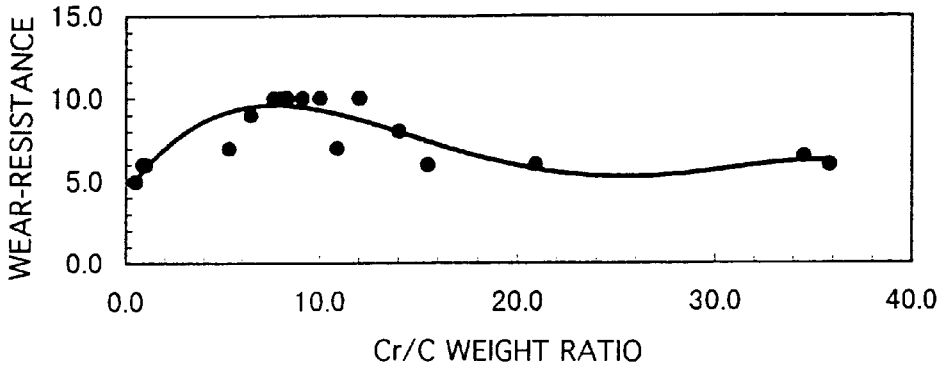
FIG. 13 is a graph indicating the relation of Cr/C weight ratio to wear-resistance.

As regards the Cr/C wt.-ratio, over 10.00 will worsen the anisotropic size-change during the heat-treatment (FIG. 10), the maximum size-change (FIG. 11), and the machinability (FIG. 12), all. Further, as shown in FIG. 13, wear-resistance falls down at the less than 6.00 wt. %. Because of the above Cr/C wt.-ratio must be 6.00~10.00.

Figure 14:
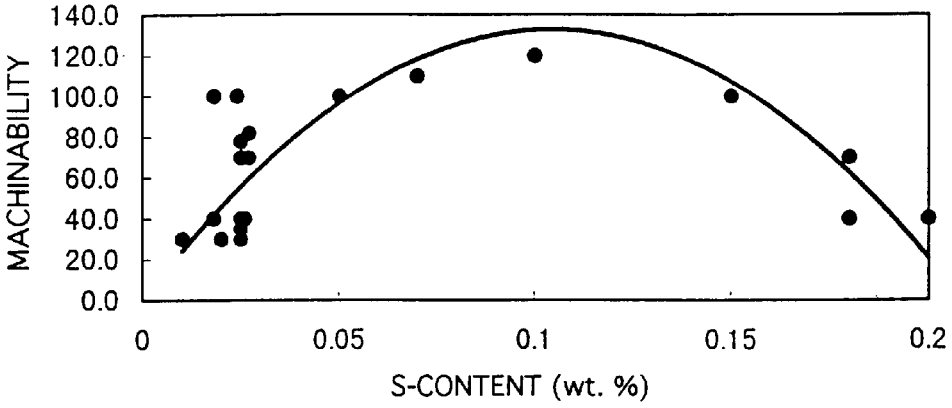
FIG. 14 is a graph indicating the relation of S-content (wt. %) to machinability.

As shown in FIG. 14, S-content of less than 0.04 and over 17.00 wt. %, respectively, will worsen machinability. So, S-content is preferable to be 0.04~17 wt. %.

As regards the prehardened steel described in the claim 2, the inventors improved the machinability of the tempered steel remarkably, minimizing the size-change contingent to heat-treatment, and at the same time, keeping wear-resistance at the level as high as SKD 11. The present invention will make JIS SKD 11 steel machinable even after hardening and tempering, by means of further limitation of the contents of various components than the prior art. According to the present invention, machining work can be performed even after hardening/tempering. Therefore, the machining time can be shortened, leading to the reduction of die manufacture cost. Moreover, machining work after heat-treatment will bring no error in the size of the dies finished.

According to our experiments, components must be (wt. %)

Cr: 1.10~1.35,

Si<0.30

Cr: 9.00~11.00,

Mo: <1.35

V: 0.45 with wt. ratio of Cr/C being 0.60~10.00.

However in case the wt. percentages for C, Si, Cr, Mo, V and S are 1.15, 0.15, 10, 1.0, 0.2, and 0.08 respectively, the machinability after hardening and tempering is low, though the wear-resistance after heat-treatment and the machinability during tempering the good, in comparison with JIS SKD 11.

In case said wt. percentages are 1.2, 0.25, 10, 1.2, 0.3, and 0.45, respectively, not only the wear-resistance but also the machinability after hardening and tempering can be remarkably improved.

Therefore, in order to achieve both the high machinability after hardening and the wear-resistance after heat-treatment, the contents (wt. %) of each components must be:

C: 1.10~1.35,

Si: 0.175~0.30

Cr: 9.00~11.00,

Mo>1.10

V: 0.25~1.20, with S≦0.04 being added for further satisfactory machinability.

The reasons why the contents of every components, for the prehardened cold tool steels of the present invent, are specified so strictly, as described, as follows.

Figure 19:
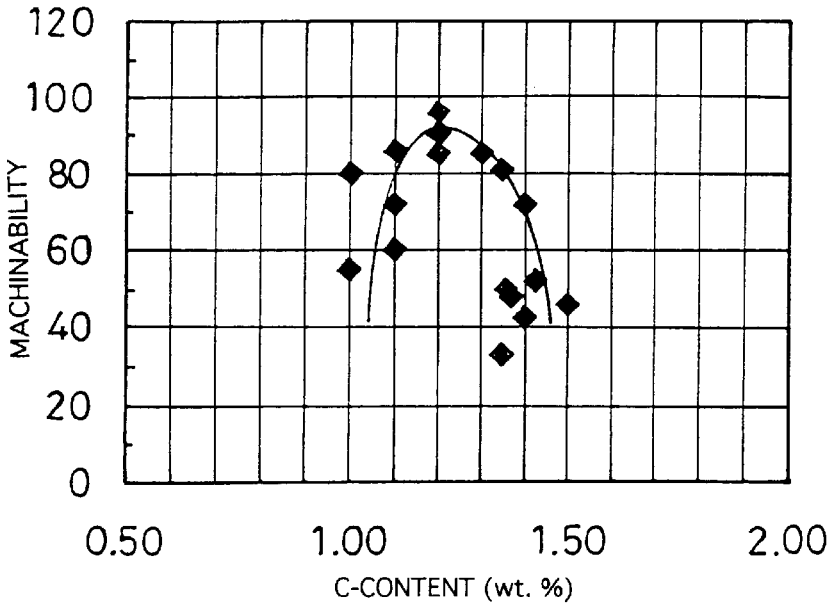
FIG. 19 is a graph indicating the relation of C-content (wt. %) to machinability.
Figure 20:
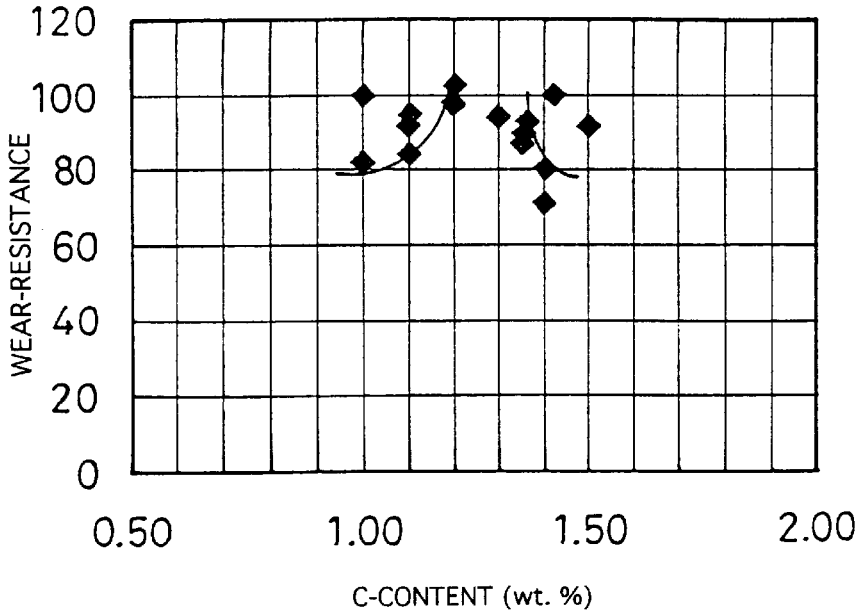
FIG. 20 is a graph indicating the relation of C-content (wt. %) to wear-resistance.

As regards C, in case wt. % is 1.10 or less, and 1.35 or more, the machinability and the wear-resistance are worsened, remarkably. Highest machinability and wear-resistance can be attained by 1.20 wt. % (FIGS. 19 and 20).

Figure 21:
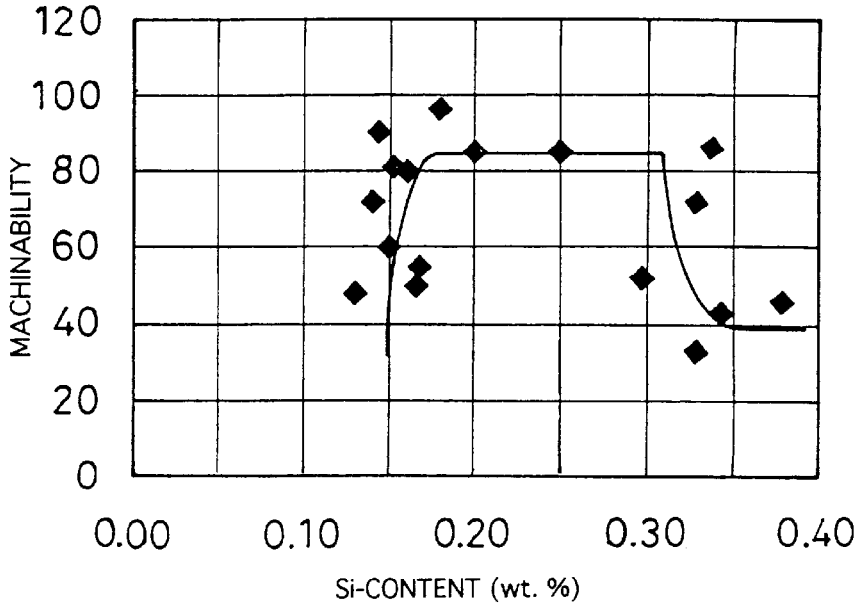
FIG. 21 is a graph indicating the relation of Si-content (wt. %) to machinability.
Figure 22:
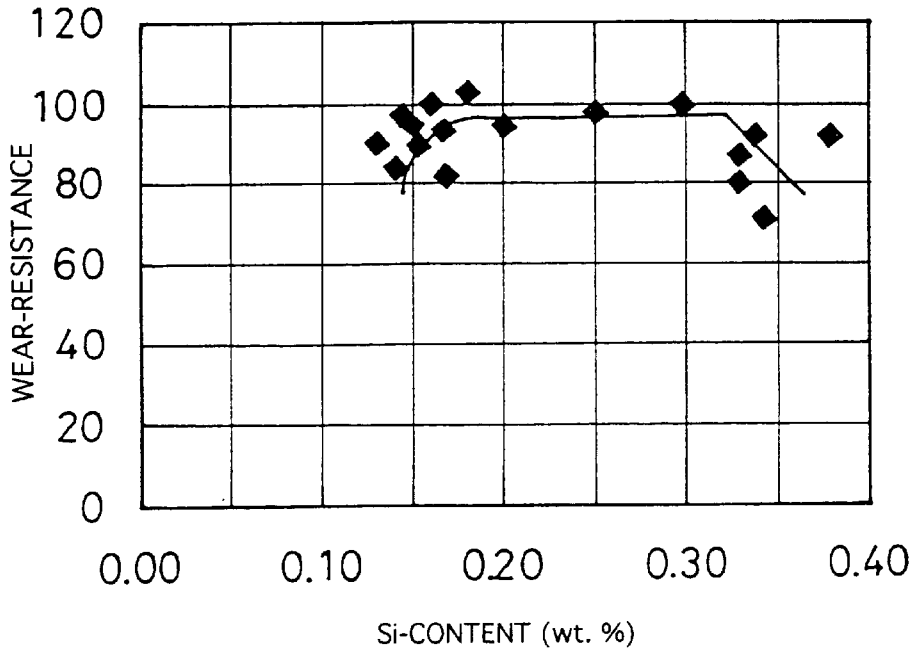
FIG. 22 is a graph indicating the relation of Si-content (wt. %) to wear-resistance.

As regards Si, the wt. % of 0.175 or less and of 0.30 or more will worsen the machinability. Further, that of 0.175 or less and of 0.35 or more will worsen the wear-resistance. Therefore the optimum wt. % of Si can be specified at 0.175~0.30 (FIGS. 21 and 22).

Figure 26:
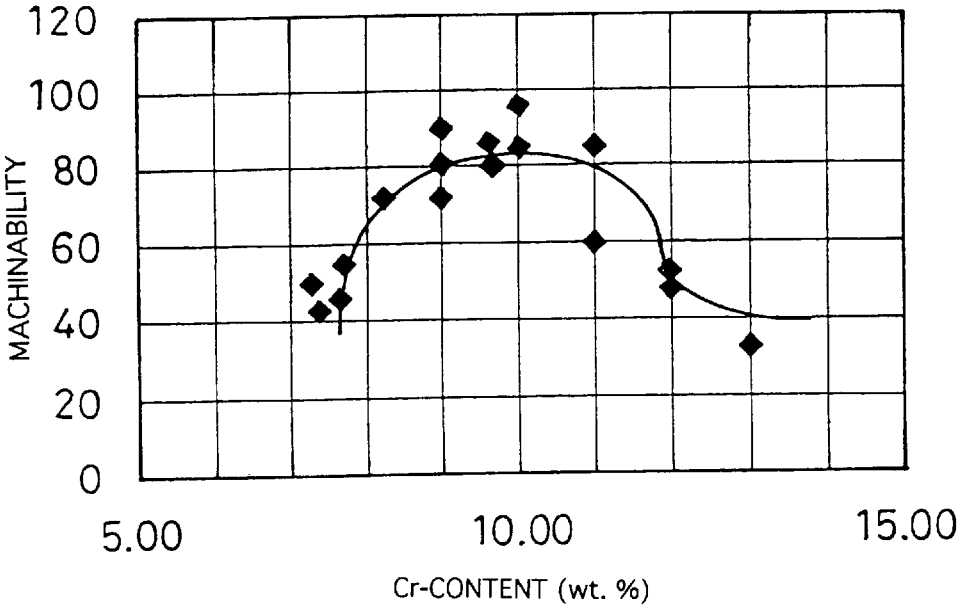
FIG. 26 is a graph indicating the relation of Cr-content (wt. %) to machinability.
Figure 27:
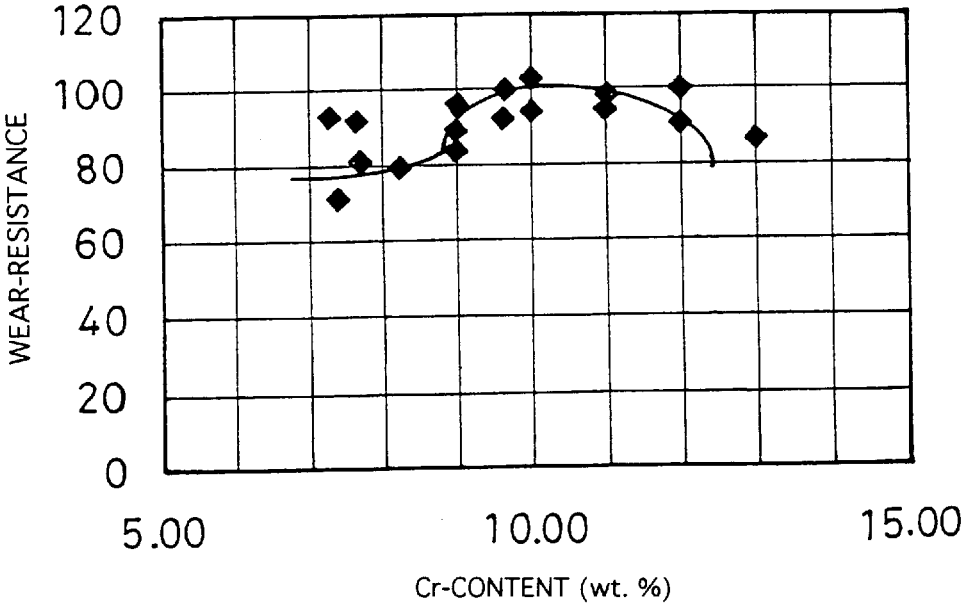
FIG. 27 is a graph indicating the relation of Cr-content (wt. %) to wear-resistance.

As regards Cr, the wt. % less than 9.00 and 11.00 or more will worsen the machinability and wear-resistance. Therefore, the optimum wt. % must be 10.50 (FIGS. 26 and 27).

Figure 23:
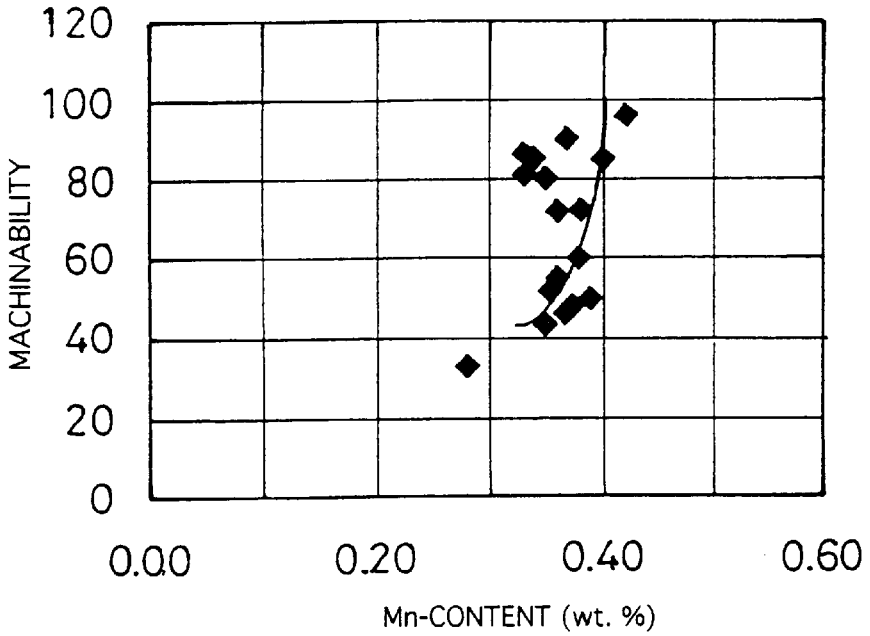
FIG. 23 is a graph indicating the relation of Mn-content (wt. %) to machinability.
Figure 24:
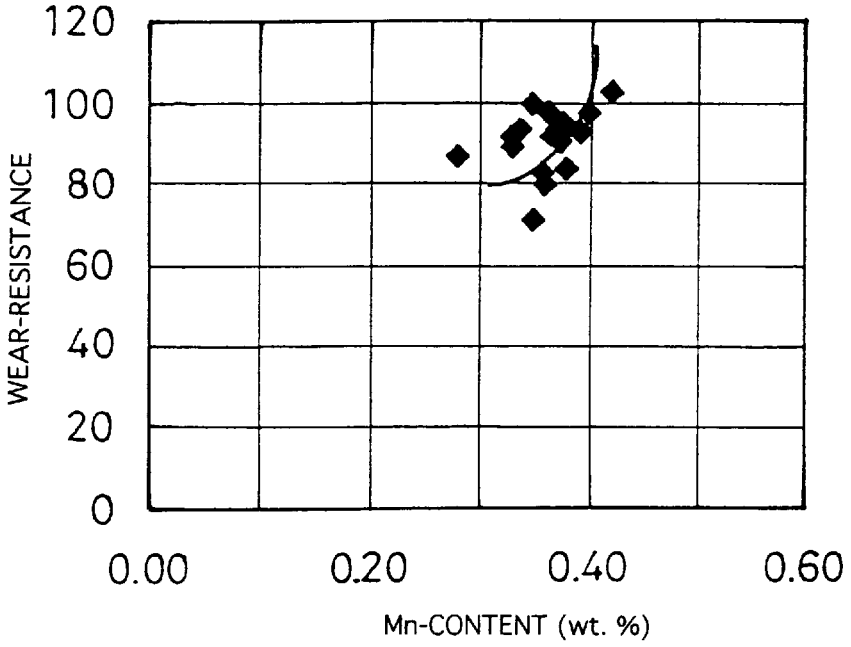
FIG. 24 is a graph indicating the relation of Mn-content (wt. %) to wear-resistance.

As regards Mn, the wt. % less than 0.3 will worsen the machinability. Therefore, the optimum wt. % must be 0.3 wt. beyond 2.42. (see FIG. 23)

Figure 28:
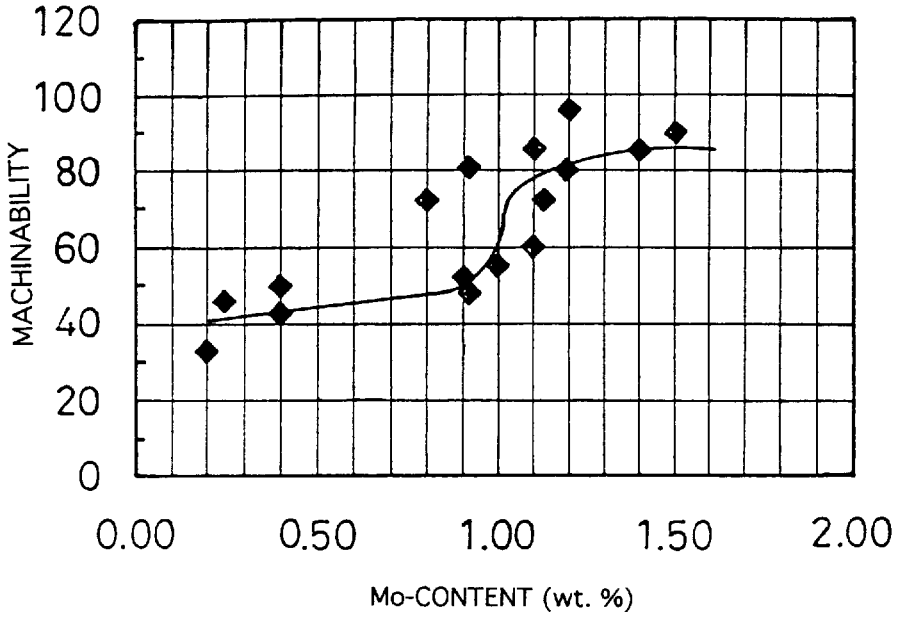
FIG. 28 is a graph indicating the relation of Mo-content (wt. %) to machinability.
Figure 29:
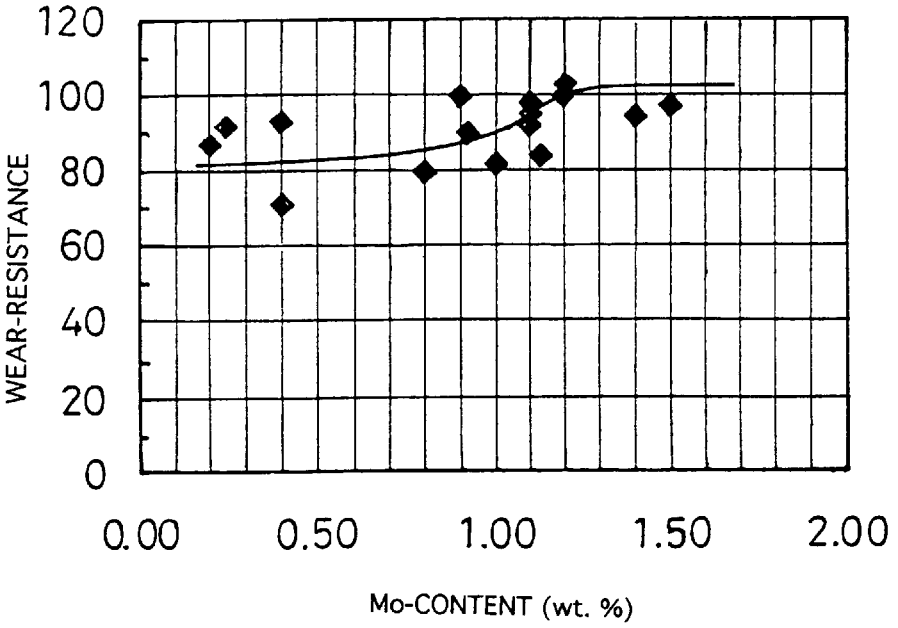
FIG. 29 is a graph indicating the relation of Mo-content (wt. %) to wear-resistance.

As regards Mo, the wt. % less than 1.10 will worsen the machinability an wear-resistance. Further, said % of 1.20 or more will no longer improve both the machinability and wear-resistance. Therefore, the optimum wt. % must be 1.20, for the lowest manufacturing cost, too (FIGS. 28 and 29).

Figure 30:
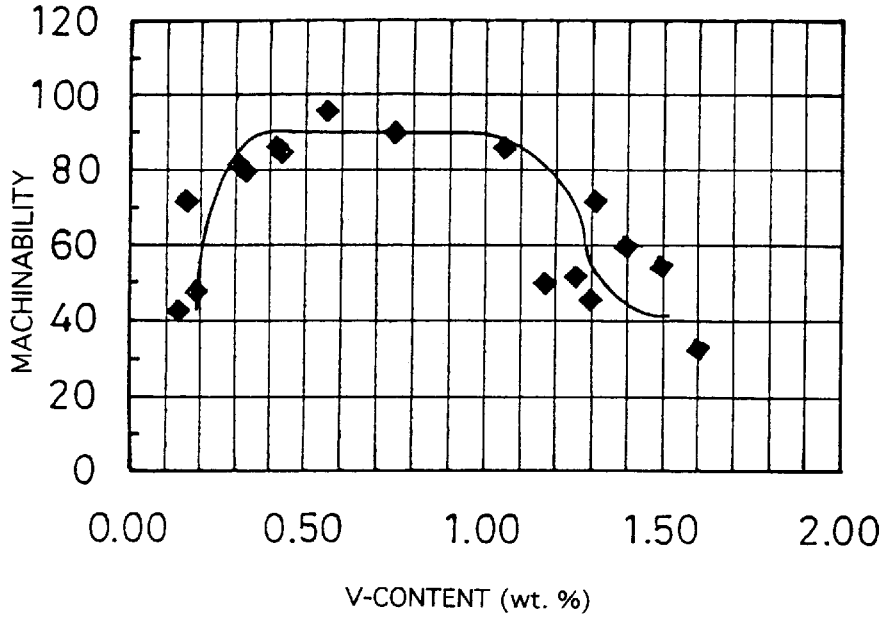
FIG. 30 is a graph indicating the relation of V-content (wt. %) to machinability.
Figure 31:
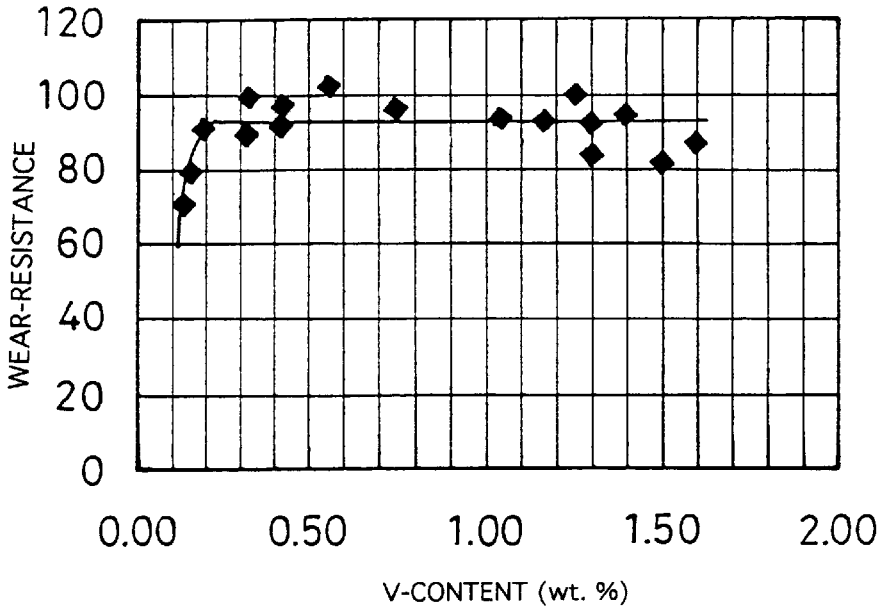
FIG. 31 is a graph indicating the relation of V-content (wt. %) to wear-resistance.
Figure 32:
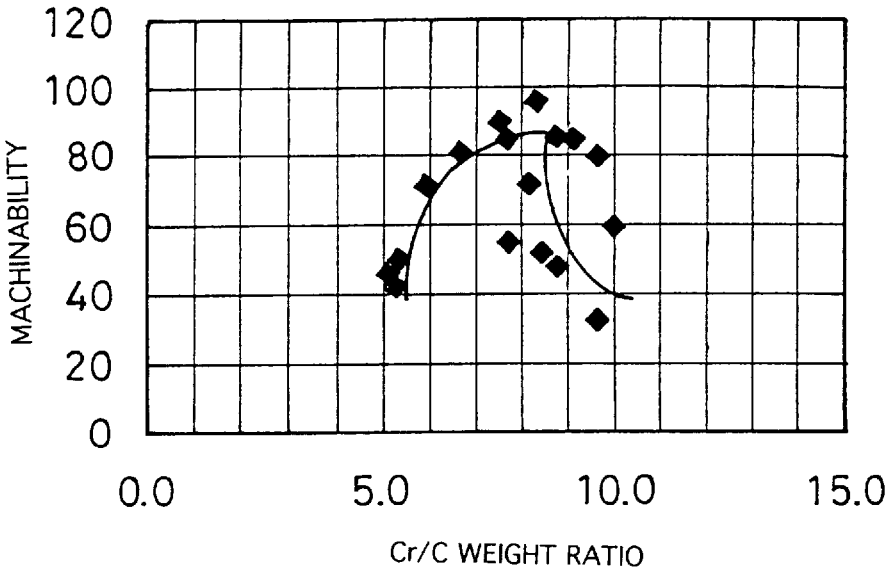
FIG. 32 is a graph indicating the relation of V-content (wt. %) to wear-resistance.
Figure 33:
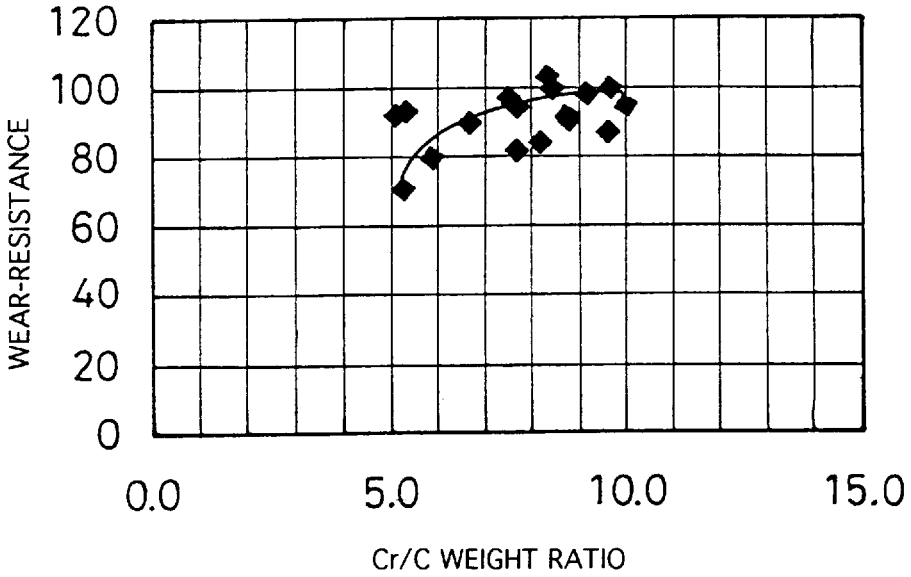
FIG. 33 is a graph indicating the relation of Cr/C weight ratio to wear-resistance.

As regards V, the wt. % of 0.25 or less and of 1.20 or more will worsen the machinability. Further, the wt. % less than 0.20 will worsen the wear-resistance, remarkably. So, the optimum wt. % must be 0.30, for minimizing the manufacture cost, too (FIGS. 30 and 31). Further, in case the wt. % is beyond 0.45, the maximum size-change during heat-treatment becomes greater. Moreover, V will make crystal particles finer and improve the wear-resistance. For this purpose, the wt. % must be 0.20 or more. Therefore, the wt. % of V is preferred to be 0.20~0.45.

Figure 25:
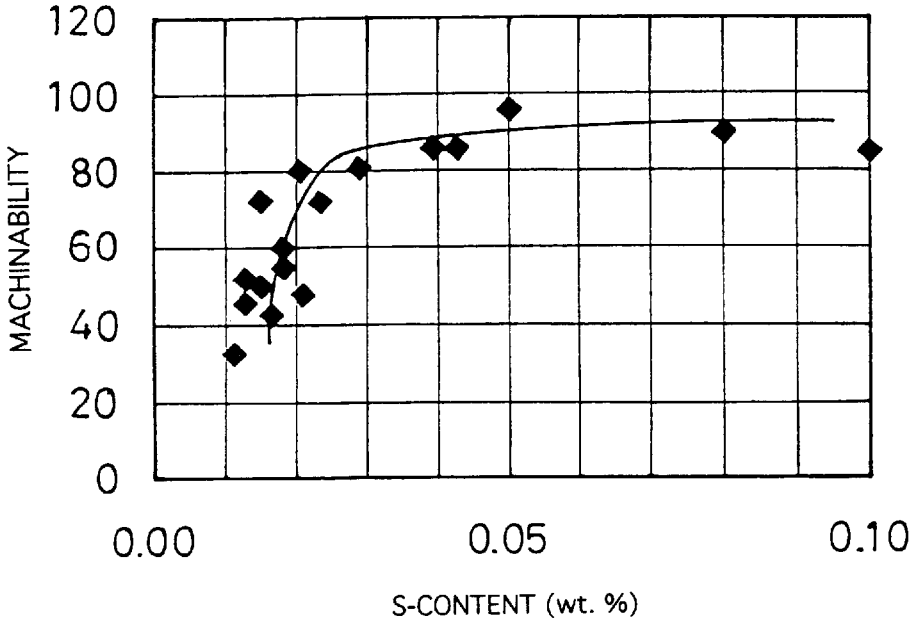
FIG. 25 is a graph indicating the relation of S-content (wt. %) to machinability.

As regards S, the wt. % less than 0.04 will no longer improve the machinability (FIG. 25). Further, the forgeobility during heated state will be worsened, in case the wt. % is 0.17 or more.

In the heat-treatment of tool alloy-steel, the residual austenite will not decompose thoroughly by tempering. So, about 5~30% of austenite will remain intact and is construed to cause the size-change after very gradual decomposition (Jpn. Pat. Publn. No. H9-125204 etc.).

Considering the residual austenite, heat-treatment and hardness need to be specified for improving the wear-resistance and machinability, at the same time. Considering the wear-resistance and machinability, at the same time. Considering the wear-resistance and machinability, at the same time, Wear-resisting machinability index shall be:

$25329-0.325\times(HRC)^3$ $+27.5\times(HRC)^2$ $+15.9\times(\text{wt. \% of residual austenite})^2$ $-329.9\times\text{wt. \% of residual austenite}$ The finding as above, was done from the Experimental Result (Table-1) and the presuming equation based on the tropic analysis thereof.

TABLE 1

| | Hardening Temp. | Tempering Temp. | | | Hard-ness | Residual austenite | Wear- | Machina-bility | Machina-bility | Wear resisting | Wear-resisting machinability Index |
|---|---|---|---|---|---|---|---|---|---|---|---|
| | (° C.) | #1 | #2 | #3 | (HRC) | % | resistance | mm | Index | machinability | (Dual tropic) |
| SKD11 | 1020 | 180 | null | null | 61 | 12.0 | 99 | 49.0 | — | — | — |
| | 1010 | 200 | 200 | null | 60 | 10.0 | 99 | 50.0 | — | — | — |
| | 1025 | 220 | 220 | 200 | 60 | 9.5 | 100 | 51.0 | — | — | — |
| | 1030 | 415 | null | null | 58 | 9.0 | 100 | 60.0 | — | — | — |
| | 1010 | 312 | 300 | 320 | 58 | 9.0 | 100 | 60.0 | — | — | — |
| | 1020 | 510 | null | null | 61 | 5.8 | 99 | 49.0 | — | — | — |
| | 1010 | 515 | 510 | null | 61 | 0.0 | 97 | 49.0 | — | — | — |
| | 1030 | 510 | 510 | 510 | 61 | 0.0 | 897 | 49.0 | — | — | — |
| | 1030 | 505 | 505 | null | 61 | 0.0 | 98 | 58.0 | — | — | — |
| | 1030 | 520 | 535 | null | 58 | 0.0 | 99 | 80.0 | — | — | — |
| | 1030 | 560 | 545 | null | 55 | 0.0 | 87 | 178.0 | — | — | — |
| Steels of the present invention | 1020 | 220 | null | null | 51 | 10.3 | 100 | 74.0 | 1.5 | 150 | 198 |
| | 1010 | 210 | 200 | null | 60 | 8.7 | 98 | 86.0 | 1.7 | 167 | 174 |
| | 1025 | 205 | 195 | 200 | 60 | 8.5 | 100 | 101.0 | 2.0 | 200 | 211 |
| | 1010 | 400 | null | null | 58 | 10.0 | 99 | 312.0 | 5.2 | 515 | 537 |
| | 1030 | 300 | 300 | 295 | 58 | 7.8 | 95 | 381.0 | 6.5 | 618 | 610 |
| | 1020 | 510 | null | null | 61 | 5.0 | 99 | 217.0 | 4.4 | 434 | 448 |
| | 1010 | 510 | 510 | null | 61 | 2.5 | 105 | 365.0 | 7.5 | 788 | 752 |
| | 1030 | 510 | 510 | 500 | 61 | 0.0 | 105 | 584.0 | 12.0 | 1260 | 1477 |
| | 1030 | 180 | 510 | 500 | 61 | 0.0 | 98 | 1015.0 | 17.5 | 1717 | 1608 |
| | 1030 | 530 | 532 | null | 58 | 0.0 | 99 | 2000.0 | 25 | 2475 | 2340 |
| | 1030 | 540 | 545 | null | 55 | 0.0 | 70 | 6230.0 | 35 | 2450 | 2416 |
| | 1030 | 570 | 565 | null | 51 | 0.0 | 32 | 4216.0 | 57 | 1802 | 1909 |

Figure 16:
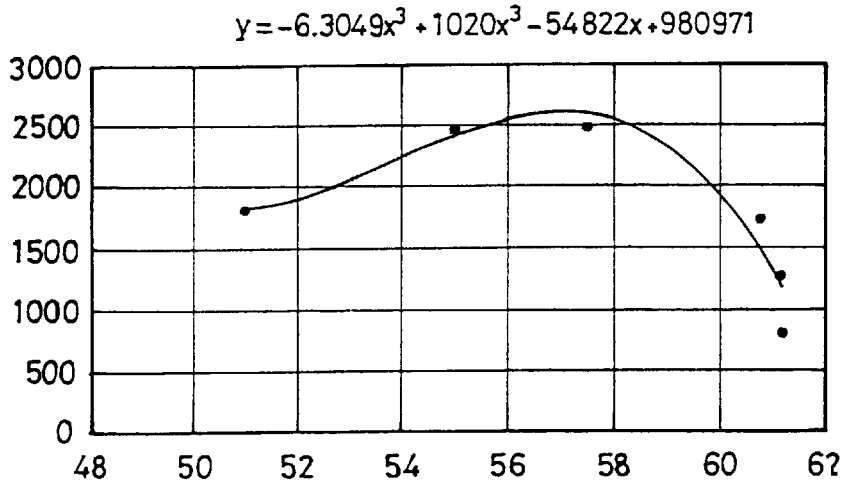
FIG. 16 is a graph indicating the relation of hardness to wear-resisting machinability, on a steel of the present invention.

Presumed equation of dual tropic analysis:
Wear-resisting machinability index = 25329~0.325 × $(HRC)^3$ + 27.05 × $(HRC)^2$ + 15.9 × (wt. % of residual austenite)$^2$ − 329.9 × wt. % of residual austenite Further, FIG. 16 indicates the relation of the hardness of the presently invented steel-2 to the wear-resisting machinability index, wherein, the experimental conditions are as follows:

Heat-treatment:

Vacuum heat-treatment (Cooled by Nitrogen)

Evaluation of machinability:

Tool life is compared pursuant to the distance until the tool breaks down.

Super hard coating endmill (2 blades), 2 ϕ

Cutting speed: 23.2 m/minute

Feeding: 0.006 mm/blade

Notching: 2 mm×0.1 mm, Dry-type

In order to secure the wear-resistance equivalent to that of SKD 11 and to improve the machinability, the wear-resisting machinability index must have the hardness ranging 52~60 HRC, for the cold tool steal of the present invention.

Further, in order to improve the machinability over 2.5 times as high as, the hardness must be controlled at 55~59 HRC, with the target being 57 HRC, as shown in Table 2.

Results in Table-2, were obtained by double heat-treatments comprising high temperature tempering, respectively.

TABLE 2

| | | | | | |
|---|---|---|---|---|---|
| SKD 11 | | | | | |
| Hardness | 60 | 58 | 55 | 52 | 50 |
| Machinability | 52 | 55 | 77 | 156 | 169 |
| Wear-resistance | 100 | 97.9 | 91.1 | 50 | 16 |
| Steel of the present invention - #1 | | | | | |
| Hardness | 60 | 58 | 55 | 52 | 50 |
| Machinability | 85 | 127 | 168 | 181 | 184 |
| Wear-resistance | 98 | 96.9 | 87.5 | 42.4 | 14 |

TABLE 2-continued

| | | | | | |
|---|---|---|---|---|---|
| Machinability Index | 1.63 | 2.32 | 2.18 | 1.16 | 1.09 |
| Wear-resisting Machinability Index | 160.2 | 224.5 | 1909 | 49.2 | 15.0 |
| Steel of the present invention - #2 | | | | | |
| Hardness | 60 | 58 | 55 | 52 | 50 |
| Machinability | 90 | 138 | 180 | 200 | 204 |
| Wear-resistance | 103 | 98.9 | 92.5 | 55.1 | 4.9 |
| Machinability Index | 1.73 | 2.50 | 2.34 | 1.28 | 1.21 |
| Wear-resisting Machinability Index | 178.3 | 247.3 | 216.2 | 70.6 | 5.9 |

Speaking of limitation of residual austenite up to 2.5% for minimizing the heat-treatment size-change, heat-treatment and hardness must be specified for improving machinability and wear-resistance even at the high hardness.

Further, tempering after hardening must be executed twice at 510~570° C. for rendering the residual austenite to be 2.5% or less. In this case, considering both wear-resistance and machinability, the equation must satisfy the following:

$$\text{Wear-resisting machinability index}=0.84\times(HRC)^5+134.4\times(HRC)^2-7120\times(HRC)+12069$$

Figure 17:
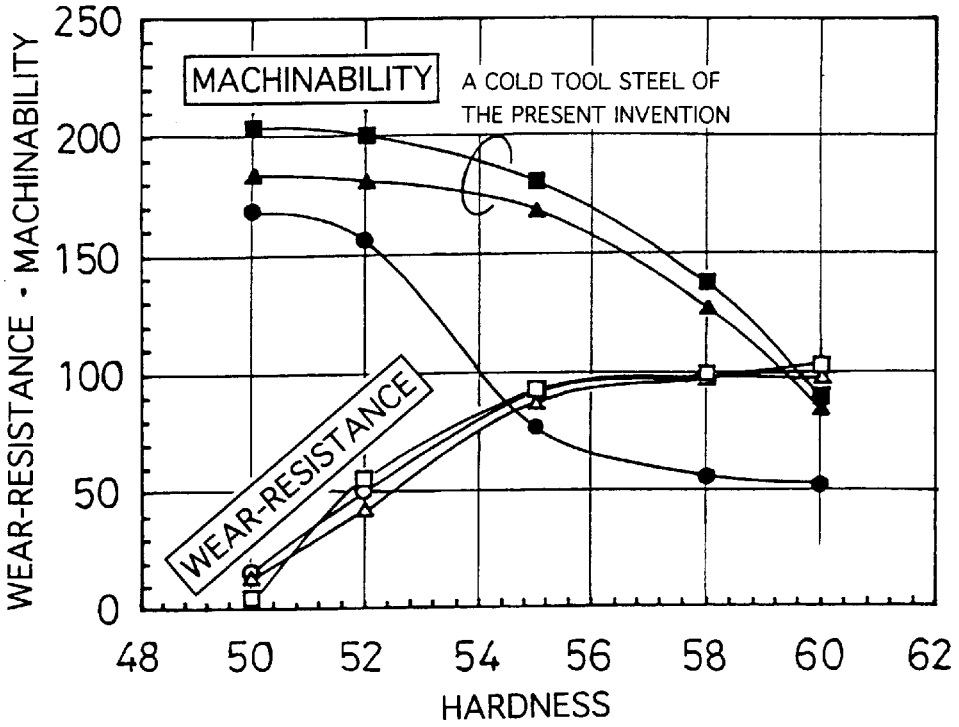
FIG. 17 is a graph indicating the relation between machinability, wear-resistance and hardness, regarding a SKD 11 steel and a cold tool steel of the present invention comprising residual austenite of 2.5 wt. % or less.
Figure 18:
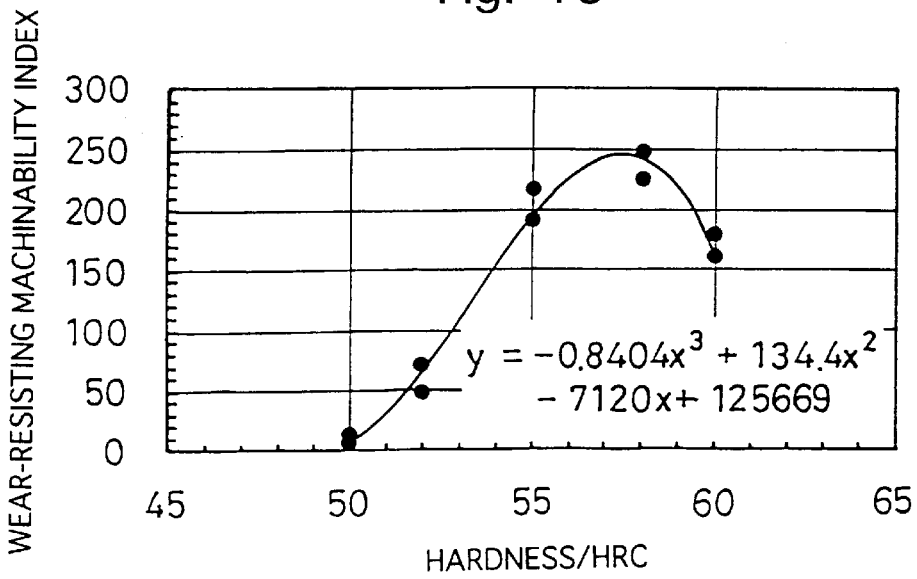
FIG. 18 is a graph adjusting the FIG. 17 into the relation of wear-resisting machinability index to hardness.

The above-mentioned equation was found by FIGS. 17 and 18, as aforementioned. It is essential for the present invention to keep hardness at 54.8~60 HRC, for improve machinability by 80% or over with the wear-resistance being secured equivalent as SKD11. Further, for improving the machinability over twice as high, the hardness must be controlled at 55.9~59 HRC.

As mentioned above, the cold tool steel tried by us consist essentially of 1.10~1.35 wt. % C, 9.00~12.00 wt. % Cr, 0.10~1.35 wt. % Si, with 6.00~10.00 wt. ratio of Cr/C. So, said steel has excellent machinability.

Further, addition of 0.04~0.17 wt. % S improves it for higher.

And, said steel, comprising 1.10~1.35 wt. % C, 9.00~12.00 wt. % Cr, with 1.00~10.00 wt. ratio of Cr/C, has high wear-resistance.

Further, comprising 6.00~10.00 wt. ratio of Cr/C, 0.20~0.45 wt. % V, 1.00~1.35 wt. % Mo, the maximum size-change of said steel has been improved. Moreover, the anisotropical size-change contingent to heat-treatment has been improved because said steel comprises 0.10~1.30 wt. % Si, 1.00~1.35 wt. % Mo, and 6.00~10.00 wt. ratio of Cr/C.

And further, the cold tool steel as set forth in claim 2 consist essentially 1.20~1.35 wt. % C, 0.20~0.30 wt. % Si, 0.30~0.42 wt. % Mn, 9.00~11.00 wt. % Cr, 1.10~1.35 wt. % Mo, 0.20~0.14 wt. % V. Therefore, the machinability after hardening/tempering is excellent, and to be improved for more by adding 0.04~0.17 wt. % S.

Moreover, the wear-resisting machinability index satisfies the following equation:

$$1800 < \text{Wear-resisting machinability index}$$

namely, $$1800 < 25329 - 0.325 \times (HRC)^3 + 27.05 \times (HRC)^2 + 15.9 \times (\text{wt. \% of residual austenite})^2 31\ 329.9 \times (\text{wt. \% of residual austenite})$$

Therefore, the wear-resistance as high as that of SKD11 is secured, and at the same time the machinability and the maximum heat-treatment size-change are improved even if there is austenite remained.

Further, since the hardening/tempering are done twice and over at 505~570° C. resulting in the hardness of 55~60 HRC, the machinability and wear-resistance are improved remarkably. In case said heat-treatment is done at 510~570° C., and hardness is 56~59 HRC, said excellent features are improved for more.

EXAMPLES

The present invention is described pursuant to the examples, but not limited thereto.

Preparation of Test Pieces 18 and 17 test-pieces for machinability/wear-resistance test and anisotropic size-change contingent to heat treatment, comprising such contents (wt. %) as shown in Tables-3 or 4, respectively, were prepared.

Machinability Test (Test Piece: Table-3)

Tempered steel pieces (HRB 85~98) were side-cut by Hice-endmill [Notched 0.5 mm (radial direction)×15 mm (axial direction)]. The wear extent of tool blade-tip up to 400 mm was determined as 100, after cutting SKS93. Comparing with said standard, the wear-resistance of pieces were tested.

Machinability Test (Test Piece: Table-4)

Tempered steel piece (HRB 85~98) was side-cut (Notch: Radial direction 0.5 mm×axial direction 15 mm) by Hice-endmill. Then, machinability was tested pursuant to the following conditions:

Heat-treatment:

Vacuum heat-treatment (Refrigerant: Nitrogen)

Hardening at 1020° C.

Twice tempering at 500~570° C.

Evaluation of machinability:

Drill: Carbide drill (1.5 ϕ)

Cutting speed: 10 m/minutes

Feed: 0.1 mm/rev.

Depth: 4.5 mm

Cutting oil: Emulsion type, water-solution

Tool life until the break-down occurs on 60 HRC of SKD 11 was determined as 50 Machinability was compared with said standard.

Wear-Resistance Test

Tester: Ohgoshi-type wear-tester

Mating material: SUJ2

Wear conditions: Ultimate load of 6.3 kgf was applied at 0.3 m/sec. to attain 400 mm wear. The wear-extent of SKD 11 at said point was determined as 10. Pursuant to said standard, wear of each piece was tested.

Test of Anisotropic Size-change Contingent to Heat-treatment

150×120×20 mm test piece was vacuum hardened at 940~1030° C., followed by tempering at 200~550° C. The greatest size-change compared with the original size was determined as the maximum size-change in percentage. Then, the extent of differences between size-changes on the length, on the width, and on the thickness, respectively was determined as the anisotropic property of size-change.

Table-3 indicates the test-results on machinability, wear, and anisotropic size-change of test pieces and standard samples. Further, FIG. 1~14 indicate said test-results pursuant to components and contents thereof, respectively.

According to Table-3, the steels of the present invention are found superior than the standard pieces, as regards machinability, wear-resistance, and anisotropic size-change, all.

And, according to FIGS. 1~14, the components and the contents in the steels of the present invention are found very reasonable.

According to Table-4, steels of the present invention are at equal or superior level to standard pieces, on machinability, wear-resistance and size-change by heat-treatment, all. On the contrary, conventional steels apart from the present invention can not attain satisfactory results.

Figure 15:
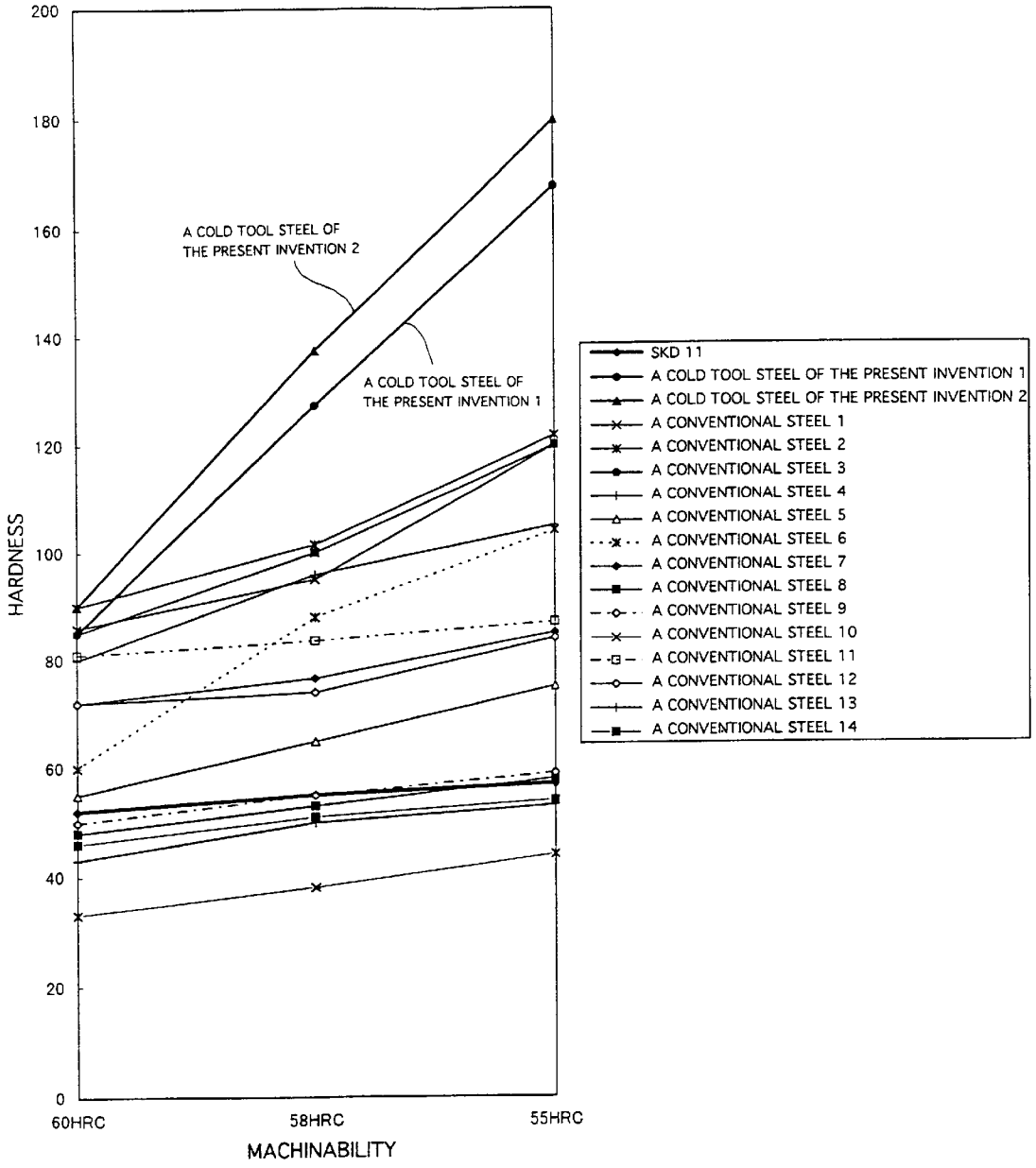
FIG. 15 is a graph indicating the comparison between SKD 11 steel, a conventional steel and a cold steel of the present invention, as regards machinability.

FIG. 15 indicates a graph of the results of machinability as stated in Table-1.

Further, FIGS. 19~33 reveals that the foundations, specifying the components and content % of there for the present invention, are very correct and reasonable.

Next, with FIG. 34, the number of tools used for manufacturing a connecting rod is shown, in comparison with that of SKD 11. The specifications of said connecting rod are tabled at the bottom of FIG. 34, together with the number of tools. Further, the conditions for heat-treating die steels and the evaluating method for machinability are as follows:

Heat-treatment:

Vacuum heat-treatment (Refrigerant: Nitrogen)

Hardening at 1020° C.;

Twice tempering at 500~570° C.

Machinability:

Tool Used; Carbide coating endmill (2 blades)/2ϕ Ball endmill.

Tool-life was compared by counting the number of tools used for finishing the die.

Test results:

Comparing with SKD 11, the steel of the present invention can be out for more easily at each hardness.

Further, using a high-speed machining center, under various test conditions, air-blow type high bard cutting test was executed for comparing the steel of the present invention with SKD 11, at 60 HRC, as follows:

Test No. 1

Tool: Tin-coated carbide mill, ϕ4, 2 blades

Conditions:
S12000/F2000,
Z-notch: 4.0 Side-notch: 0.2

SKD-11: Broke down at 1,000 mm (0.8 $cm^2$) cutting distance.

The presently invented steel: withstood up to 1.625 m cutting distance (13 $cm^2$) which equaled 1.6 times as long as SKD.

Test No. 2

Tool: Tin-coated carbide mill, ϕ6, 2 blades

Conditions:
S3000/F1000,
Z-notch: 4.0 Side-notch 0.1

SKD-11: Broke down at 1,250 mm (0.5 $cm^2$) cutting distance,

The presently invented steel: withstood up to 10,000 mm cutting distance (40 $cm^2$), which was 80 times as long as SKD.

The machinability of said steel can be construed far superior than that of SKD.

Moreover, using a WA grindstone, grind-burns were compared with SKD 11, under conditions as follows:

Type of grinding: Surface grinding

Grindstone: WA (Alumina)

Particles: 32A (Size 46/Binding: J/Binder: VBE)

Size of stone: 205×19.0×32.75

Grinding distance: 1.2 m

Cutting fluid: Water-soluble cutting oil

Test Results

Grind-burns were visually measured at various feddings:

| Feeding (mm): | 0.0025 | 0.0050 | 0.0075 | 0.0100 | 0.0170 |
|---|---|---|---|---|---|
| SKD 11: | ⊙ | Δ | x | x | x |
| Steel of the present invention | ⊙ | ⊙ | ⊙ | ○ | Δ |

legend:

⊙ No burn.

Δ Partial burns

○ A few burns x burns, overall

Figure 35:
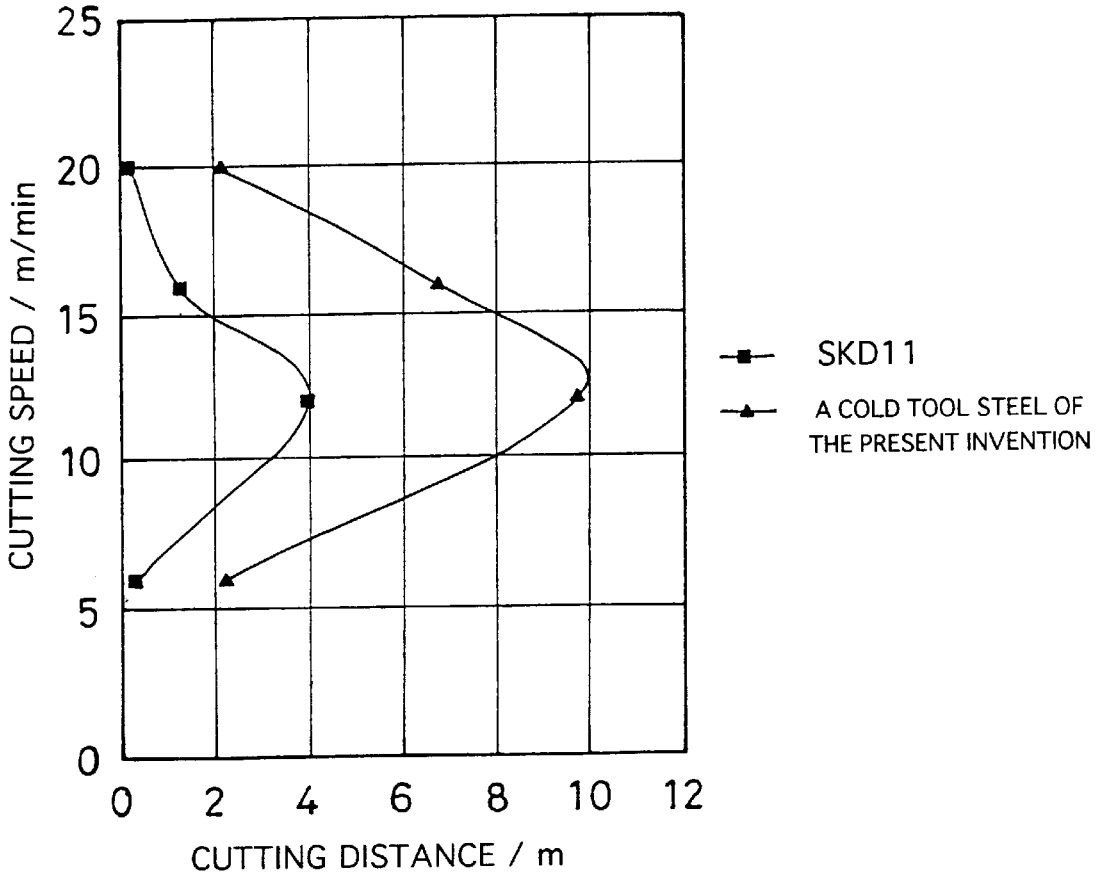
FIG. 35 is a graph comparing the machinability of the steel of the present invention with SKD 11 steel, using a roughing end mill.

Further, FIG. 35 indicates the machinability-test results, for comparing the steel of the present invention with SKD 11, using a roughing-endmill.

Conditions:

Test piece: Tempered steel

Feeding: 0.012 mm/tooth

Machine: NC fraise

Notch 6 mm

Tool: Roughing endmill, 6 mm

Cutting width: 6 mm groove

Cutting speed: 6~28 mm/min.

Cutting oil: Dry cutting

TABLE 3

| | Content of components (Wt. %) | | | | | | | | | | | |
|---|---|---|---|---|---|---|---|---|---|---|---|---|
| No. | C | Si | Mn | Cr | Mo | V | S | Cr/C | Machina-bility | Wear-resistance | Max, size-change by heat-treatment (%) | Anisotropic size-change by heat-treatment (%) |
| SKS93 | 0.98 | 0.20 | 1.00 | 0.55 | 0.02 | 0.03 | 0.019 | 0.5 | 100.0 | 5.0 | 1.105 | 0.025 |
| SKD11 | 1.50 | 0.30 | 0.40 | 12.00 | 1.00 | 0.30 | 0.020 | 8.0 | 30.0 | 10.0 | 0.115 | 0.040 |
| Test-1 | 1.10 | 0.77 | 0.30 | 17.00 | 0.50 | 0.10 | 0.025 | 15.5 | 35.0 | 6.0 | 0.120 | 0.041 |
| Test-2 | 0.49 | 0.20 | 0.30 | 13.80 | 1.00 | 0.30 | 0.180 | 34.5 | 70.0 | 6.5 | 0.994 | 0.915 |
| Test-3 | 1.00 | 0.75 | 0.35 | 14.00 | 2.00 | 1.00 | 0.025 | 14.0 | 40.0 | 8.0 | 0.220 | 0.940 |
| Test-4 | 1.00 | 0.30 | 0.75 | 5.30 | 1.10 | 0.20 | 0.200 | 5.3 | 40.0 | 7.0 | 0.079 | 0.029 |
| Test-5 | 0.70 | 0.80 | 0.68 | 7.60 | 1.20 | 0.75 | 0.018 | 10.9 | 40.0 | 7.0 | 0.124 | 0.048 |
| Test-6 | 0.38 | 0.40 | 0.38 | 13.60 | 0.54 | 0.06 | 0.180 | 35.8 | 40.0 | 6.0 | 0.088 | 0.029 |
| Test-7 | 2.10 | 0.30 | 0.40 | 13.50 | 0.10 | 0.10 | 0.025 | 6.4 | 30.0 | 9.0 | 0.102 | 0.032 |
| Test-8 | 1.00 | 0.30 | 0.60 | 10.00 | 1.00 | 0.30 | 0.026 | 10.0 | 40.0 | 10.0 | 0.103 | 0.038 |
| Test-9 | 0.95 | 0.25 | 1.10 | 0.80 | 0.10 | 0.75 | 0.025 | 0.8 | 70.0 | 6.0 | 0.125 | 0.026 |
| Test-10 | 1.00 | 0.25 | 1.05 | 1.00 | 0.10 | 0.10 | 0.027 | 1.0 | 70.0 | 6.0 | 0.100 | 0.040 |
| Test-11 | 1.20 | 0.28 | 0.35 | 10.00 | 1.35 | 0.30 | 0.024 | 8.3 | 100.0 | 10.0 | 0.110 | 0.030 |
| Test-12 | 1.45 | 0.30 | 0.40 | 12.00 | 1.00 | 1.35 | 0.010 | 8.3 | 30.0 | 10.0 | 0.115 | 0.030 |
| Test-13 | 1.00 | 0.20 | 0.30 | 12.00 | 1.45 | 1.00 | 0.025 | 12.0 | 78.0 | 10.0 | 0.165 | 0.035 |
| Test-14 | 0.11 | 0.21 | 0.33 | 2.30 | 2.09 | 1.40 | 0.027 | 20.9 | 82.0 | 6.0 | 0.220 | 0.030 |
| Test-15 | 1.20 | 0.28 | 0.35 | 10.00 | 1.35 | 0.30 | 0.050 | 8.3 | 100.0 | 10.0 | 9.120 | 0.030 |
| Test-16 | 1.10 | 0.25 | 0.20 | 11.00 | 1.35 | 0.30 | 0.070 | 10.0 | 110.0 | 10.0 | 0.120 | 0.030 |
| Test-17 | 1.25 | 0.20 | 0.29 | 9.50 | 1.35 | 0.30 | 0.100 | 7.6 | 120.0 | 10.0 | 0.120 | 0.030 |
| Test-18 | 1.10 | 0.18 | 0.30 | 10.00 | 1.35 | 0.30 | 0.150 | 9.1 | 100.0 | 10.0 | 0.120 | 0.030 |

TABLE 4

| No. | Content of components (Wt. %) | | | | | | | | Cr/C | Wear-resistance | Machinability | | | Max, size-change by Heat-Treatment(%) |
|---|---|---|---|---|---|---|---|---|---|---|---|---|---|---|
| | C | Si | Mn | S | P | Cr | Mo | V | | | 60 HRC | 58 HRC | 55 HRC | |
| SKD11 | 1.42 | 0.30 | 0.35 | 0.01 | 0.01 | 12.00 | 0.09 | 1.26 | 8.4 | 100 | 52 | 55 | 57 | 0.22 |
| The present invention-1 | 1.20 | 0.25 | 0.40 | 0.04 | 0.01 | 10.90 | 1.12 | 0.43 | 9.1 | 98 | 85 | 127 | 168 | 0.10 |
| The present invention-2 | 1.20 | 0.21 | 0.42 | 0.05 | 0.01 | 10.00 | 1.20 | 0.30 | 8.3 | 103 | 90 | 138 | 180 | 0.10 |
| Conventional steel-1 | 1.10 | 0.34 | 0.33 | 0.04 | 0.01 | 9.62 | 1.10 | 0.42 | 8.7 | 92 | 86 | 95 | 120 | 0.11 |
| Conventional steel-2 | 1.20 | 0.14 | 0.37 | 0.08 | 0.09 | 9.00 | 1.50 | 0.75 | 7.5 | 97 | 90 | 102 | 122 | 0.14 |
| Conventional steel-3 | 1.30 | 0.20 | 0.34 | 0.10 | 0.09 | 10.00 | 1.40 | 1.05 | 7.7 | 95 | 85 | 100 | 120 | 0.16 |
| Conventional steel-4 | 1.00 | 0.16 | 0.35 | 0.02 | 0.07 | 9.66 | 1.19 | 0.33 | 9.7 | 100 | 80 | 96 | 105 | 0.12 |
| Conventional steel-5 | 1.00 | 0.17 | 0.36 | 0.02 | 0.01 | 7.71 | 1.00 | 1.50 | 7.7 | 82 | 55 | 65 | 75 | 0.23 |
| Conventional steel-6 | 1.10 | 0.15 | 0.38 | 0.02 | 0.01 | 11.00 | 1.10 | 1.40 | 10.0 | 95 | 60 | 88 | 101 | 0.21 |
| Conventional steel-7 | 1.10 | 0.14 | 0.38 | 0.02 | 0.01 | 9.00 | 1.13 | 1.31 | 8.2 | 84 | 72 | 77 | 85 | 0.20 |
| Conventional steel-8 | 1.37 | 0.13 | 0.37 | 0.02 | 0.09 | 12.00 | 0.92 | 0.19 | 8.8 | 91 | 48 | 53 | 58 | 0.09 |
| Conventional steel-9 | 1.36 | 0.17 | 0.39 | 0.02 | 0.01 | 7.29 | 0.40 | 1.17 | 5.4 | 94 | 50 | 55 | 59 | 0.18 |
| Conventional steel-10 | 1.35 | 0.33 | 0.28 | 0.01 | 0.02 | 13.00 | 0.20 | 1.60 | 9.6 | 87 | 33 | 38 | 44 | 0.24 |
| Conventional steel-11 | 1.35 | 0.15 | 0.33 | 0.03 | 0.00 | 9.00 | 0.92 | 0.32 | 6.7 | 90 | 81 | 84 | 87 | 0.12 |
| Conventional steel-12 | 1.40 | 0.33 | 0.36 | 0.02 | 0.01 | 8.24 | 0.80 | 0.16 | 5.9 | 80 | 72 | 74 | 84 | 0.10 |
| Conventional steel-13 | 1.40 | 0.34 | 0.35 | 0.02 | 0.01 | 7.39 | 0.40 | 0.14 | 5.3 | 71 | 43 | 50 | 53 | 0.10 |
| Conventional steel-14 | 1.50 | 0.38 | 0.37 | 0.01 | 0.06 | 7.66 | 0.25 | 1.30 | 5.1 | 92 | 46 | 51 | 54 | 0.22 |

What is claimed is:

1. Cold tool steel consisting essentially of: 1.20~1.35 weight % C, 0.20~0.30 weight % Si, 0.3~0.42 weight % Mn, 9.0~11.00 weight % Cr, 1.10~1.35 weight % Mo, 0.2~0.45 weight % V, 0.04~0.17 weight % S, and 6.0~10.0 ratio Cr/C with the rest being Fe and impurities, and with a Rockwell hardness being within the range from about 55~60 HRC after hardening and tempering, resulting in a cold tool steel having improved machinability.

2. Cold tool steel, as set forth in claim 1, having a Wear-Resisting Machinability Index that is:

$$25329\sim0.325\times(\text{Rockwell Hardness})^3+27.05\times(\text{Rockwell Hardness})^2+15.9\times(\text{wt. \% of residual austenite})^2-329\times(\text{wt. \% of residual austenite}),$$

wherein said Index is greater than 1800.

3. Cold tool steel as set forth in claim 1, wherein hardening and tempering are executed several times at 505~570° C., resulting in a cold tool steel having 55~60 HRC Rockwell Hardness.

4. Cold tool steel as set forth in claim 3, wherein said tempering treatment is executed at 510~570° C., resulting in a cold tool steel having 56~59 HRC Rockwell Hardness.

* * * * *